US005970543A

United States Patent [19]

Barreca et al.

[11] Patent Number: 5,970,543

[45] Date of Patent: Oct. 26, 1999

[54] COMFORTER FOR CHILD'S BED

[76] Inventors: Dominic Barreca; Lori Barreca, both of 4579 Broadview Rd., Richfield, Ohio 44286

[21] Appl. No.: 08/938,417

[22] Filed: Sep. 25, 1997

[51] Int. Cl.[6] ..... A47G 9/04

[52] U.S. Cl. ..... 5/497; 5/496; 5/498; 5/499

[58] Field of Search ..... 5/482, 485, 486, 5/494, 496, 497, 498, 499

[56] References Cited

U.S. PATENT DOCUMENTS

| | | | |
|---|---|---|---|
| 1,863,256 | 6/1932 | Snoddy | 5/494 |
| 1,972,919 | 9/1934 | Chambless | 5/498 |
| 3,258,789 | 7/1966 | Banks | 5/485 |
| 3,654,646 | 4/1972 | McMahon, Jr. | 5/485 X |
| 3,824,640 | 7/1974 | Golden | 5/485 |
| 3,906,559 | 9/1975 | Bahr | 5/496 |
| 4,274,169 | 6/1981 | Standiford . | |
| 4,316,299 | 2/1982 | Friedman . | |
| 4,386,439 | 6/1983 | Reccograndi et al. . | |
| 4,402,098 | 9/1983 | McClam . | |
| 4,644,598 | 2/1987 | McQuire et al. . | |
| 5,099,531 | 3/1992 | Schmier . | |
| 5,189,744 | 3/1993 | Roberts | 5/497 |
| 5,491,853 | 2/1996 | Turnbull | 5/497 |
| 5,566,411 | 10/1996 | Eiler . | |

*Primary Examiner*—Michael F. Trettel
*Assistant Examiner*—Robert G. Santos

[57] ABSTRACT

A comforter adapted to cover a mattress and which is formed of a quilted fabric that extends over the sides and foot end of a mattress and having a seam at the corners of the foot end of the mattress. The comforter has a fabric bottom section fastened to the quilted fabric at the end and detachably secured to the sides of the quilted fabric so that the lower third of the comforter is designed for holding the comforter onto the mattress. The detachable sides may have zippers or other fasteners.

6 Claims, 2 Drawing Sheets

COMFORTER FOR CHILD'S BED

FIELD OF THE INVENTION

The invention relates to a comforter for a bed and, more particularly, to a quilted comforter boxed at the foot end and having a plain fabric bottom section extending one third the length of the comforter and fixedly attached to the foot end and detachably secured to the sides of the comforter.

SUMMARY OF THE INVENTION

This comforter is made from quilted fabric with the batting enclosed. Typically, this will be 90 inches long and 60 to 75 inches wide, designed to fit over a mattress for these beds that is typically 75 inches long from head to the foot of the mattress and 40 to 54 inches wide. This leaves 9 inches overhang on the sides and about the same at the foot of the mattress.

A cut is made in the quilted fabric at the foot of the quilted fabric at the corners so that the cuts may be sewn together to form a fitted end that will box in the mattress at the foot of the bed. A plain fabric bottom extends one third the length of the comforter and is detachably secured at its sides thereto.

DETAILED DESCRIPTION OF THE PREFERRED EMBODIMENTS

Figure 1:
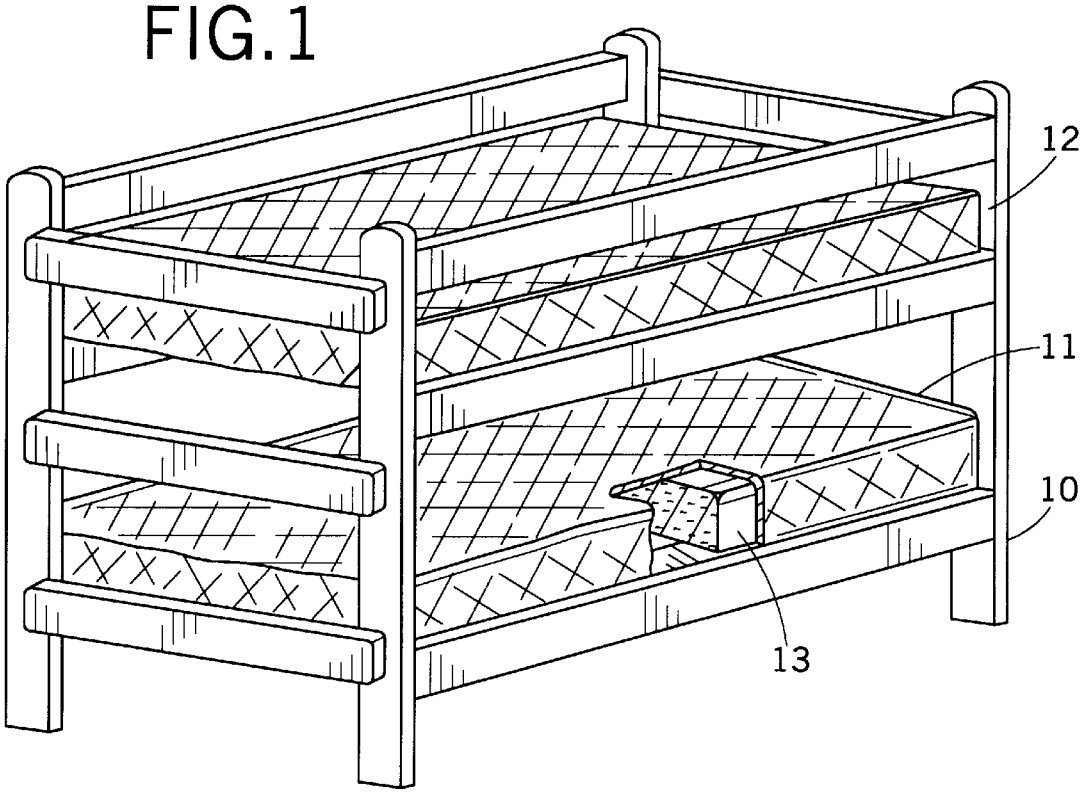
FIG. 1 is a diagrammatic view of a typical child's bunk bed with mattress.

In FIG. 1 of the drawings, 10 shows a typical bunk bed for the comforter of the present invention. The purpose is to fasten the comforter to the mattress over a fitted sheet, not shown. A lower mattress is shown at 11 and an upper mattress at 12. A cut away section is shown at 13 to illustrate how the mattresses are constructed.

Figure 2:
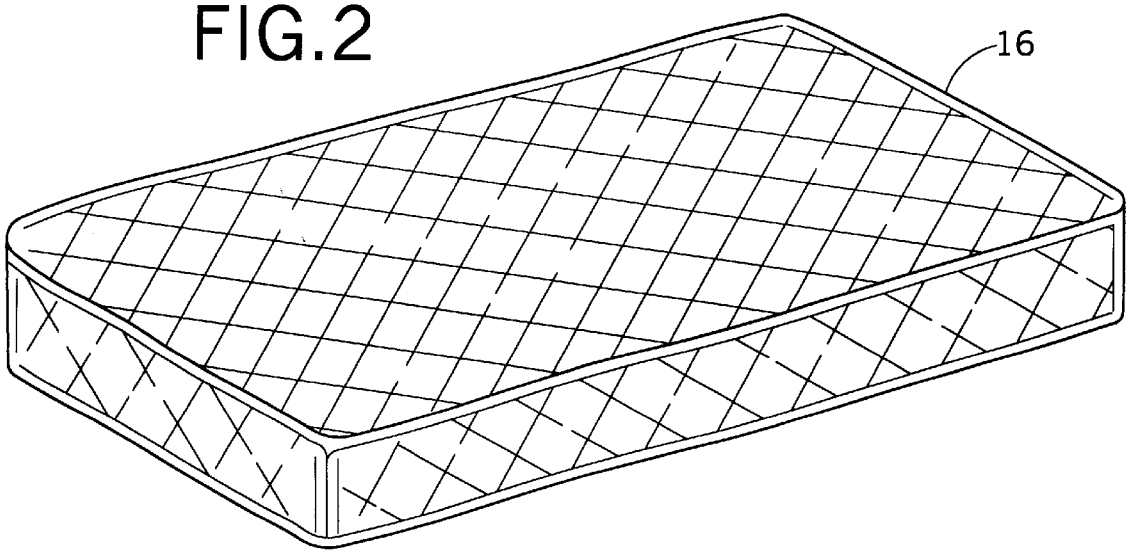
FIG. 2 is a view of the mattress.

FIG. 2 shows a top view of a mattress like those of FIG. 1, and is designated by the numeral 16.

Figure 3:
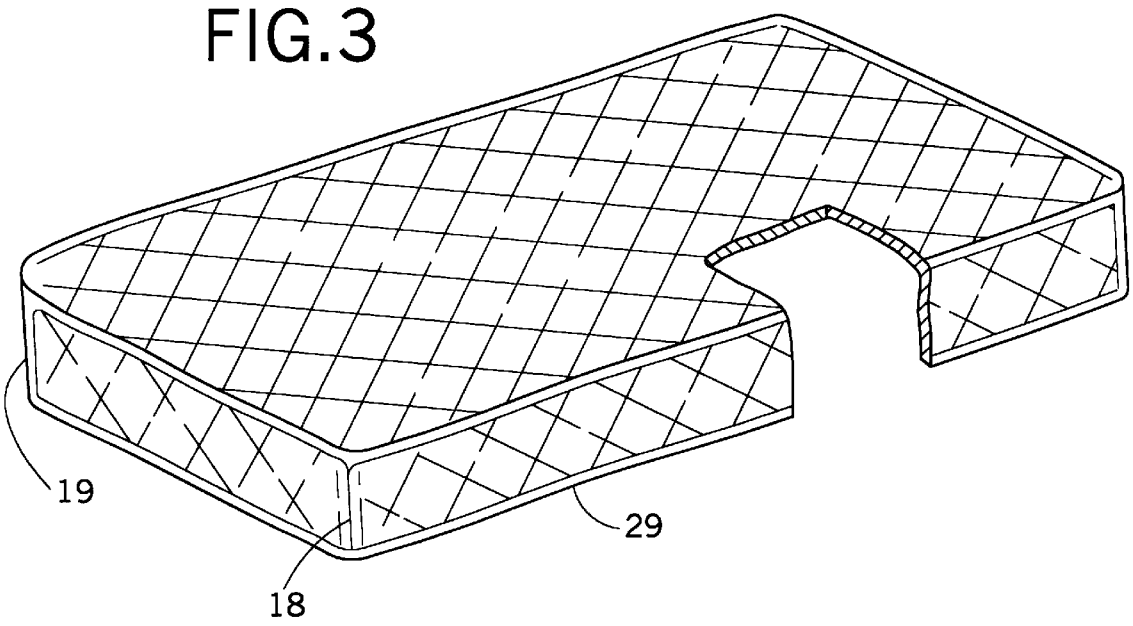
FIG. 3 is a view of the comforter from the top with a cutout portion to show its features.

FIG. 3 shows a schematic view with a portion cut out of the new comforter as it would be positioned over a mattress. The foot of the comforter is seamed at 18 and 19 so that it boxes the mattress. Sections 9 inches wide are seamed at 18 and 19. One side is shown at 29.

Figure 4:
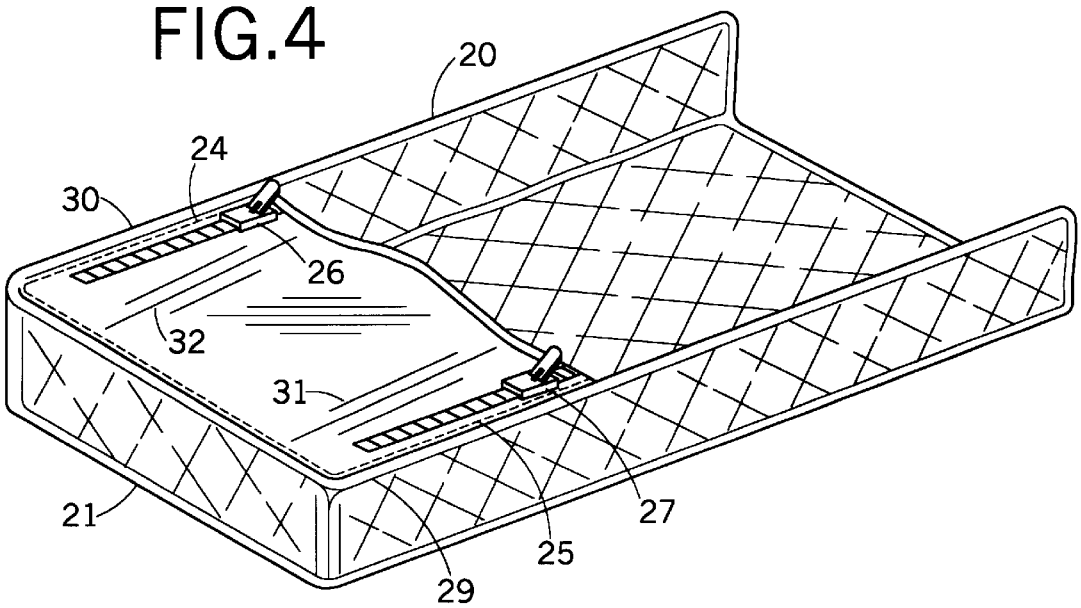
FIG. 4 is a bottom view of the comforter showing the underside of the comforter with sewn fabric sections and a detachable portion fastened with zippers.

FIG. 4 shows the underside of the comforter with a fabric piece 20 about one third the length of the comforter. The fabric piece 20 is fixedly attached to one end of the quilted fabric at 21 and the sides of the fabric piece 20 are detachably secured to the sides of the comforter at 24 and 25 by zipper fasteners at 26 and 27 extending along the sides.

In assembly on the mattress, the fabric piece 20 is slipped under the mattress from the foot and then zipped up to hold it to the sides, such as at 29. The opposite side 30 holds the other side with a zipper 26. Other fasteners such as buttons or hook and loops which are well known also could be used. Longitudinal pleats 31 and 32 are provided in fabric piece 20 and which allow foot room for the child. This provides 12 inches of room for the feet if they are upright.

This disclosure is to be construed broadly but the attached claims are the measure of the invention.

We claim:

1. A comforter adapted to cover a mattress which comprises:

a) a quilted fabric section to cover the mattress and having side sections and a foot section hanging over the mattress;

b) said foot section hanging over the foot of the mattress;

c) said foot section and side sections seamed together at the foot of the comforter to box in the mattress it is designed to cover;

d) a plain fabric bottom section covering about a third of the length of the comforter;

e) said bottom section being fixedly attached to the foot section of the comforter and forming a detachable attachment to each of the side sections to box in the mattress along both sides of the foot section which extend the entire length of the foot section which allow the plain fabric bottom section to be completely detached from the side sections of the comforter;

f) said bottom section is tucked underneath the mattress, about one third (⅓) of the way up, to hold said comforter in place.

2. The comforter of claim 1 in which the detachable attachment to the side sections are zippers.

3. The comforter for claim 1 in which the detachable attachment to the side sections are hook and loop type fastener pieces.

4. The comforter of claim 1 in which the plain fabric bottom section has 1 or more longitudinal pleats to provide for room in the comforter.

5. A method of making a quilted fabric cover having overhanging sides and a plain fabric underpiece to form a comforter adapted to cover a mattress which comprises:

a) taking a piece of quilted fabric larger than the mattress with overhanging sides and an overhanging foot;

b) fixedly attaching a plain fabric bottom section to said foot and extending said bottom section over a third of the length of the comforter; and c) detachably attaching said bottom section to the overhanging sides of the comforter to box in the lower third of the comforter around the mattress.

6. The method of claim 5 which includes the step of making said plain fabric bottom section wider than the mattress and which is pleated to allow foot room.

* * * * *